US005526586A

United States Patent [19]

Foscaro

[11] Patent Number: 5,526,586

[45] Date of Patent: Jun. 18, 1996

[54] SKI BOOT WITH IMPROVED LATERAL SUPPORT

[75] Inventor: Giancarlo Foscaro, Treviso, Italy

[73] Assignee: Nordica S.p.A., Montebelluna, Italy

[21] Appl. No.: 267,216

[22] Filed: Jul. 5, 1994

[30] Foreign Application Priority Data

Jul. 15, 1993 [IT] Italy ..... TV93A0068

[51] Int. Cl.[6] ..... A43B 5/00

[52] U.S. Cl. ..... 36/117; 36/88; 36/118

[58] Field of Search ..... 36/117–121, 109, 36/88, 89, 114, 115

[56] References Cited

U.S. PATENT DOCUMENTS

| | | | |
|---|---|---|---|
| 3,530,594 | 9/1970 | Vogel . | |
| 3,597,862 | 8/1971 | Vogel . | |
| 4,085,528 | 4/1978 | Delery | 36/121 |
| 4,308,674 | 1/1982 | Tessaro | 36/118 |
| 5,331,752 | 7/1995 | Johnson et al. | 36/115 |

FOREIGN PATENT DOCUMENTS

| | | |
|---|---|---|
| 0430821 | 6/1991 | European Pat. Off. . |
| 521288 | 1/1993 | European Pat. Off. . |
| 2653310 | 4/1991 | France . |
| 2711506 | 11/1978 | Germany . |
| 3004668 | 8/1981 | Germany . |
| 9216120 | 10/1992 | WIPO . |

*Primary Examiner*—Paul T. Sewell
*Assistant Examiner*—Marie Denise Patterson
*Attorney, Agent, or Firm*—Guido Modiano; Albert Josif

[57] ABSTRACT

Ski boot with improved lateral support including a shell connected to a quarter and having a rigid element which is monolithic or formed integrally with the shell and at least partially affects the inner side of the foot and leg and the plantar arch. The boot allows to achieve optimum ski control by distributing the efforts and ensuring rear support.

15 Claims, 3 Drawing Sheets

SKI BOOT WITH IMPROVED LATERAL SUPPORT

BACKGROUND OF THE INVENTION

The present invention relates to a ski boot with improved lateral support.

The problem of transmitting the efforts of the foot to the ski in an efficient manner, so as to achieve optimum control of said ski, is nowadays strongly felt for ski boots.

In this regard, some solutions are known, related or aimed directly at these problems. Among them, mention should be made of U.S. Pat. No. 3,545,103 which discloses a ski boot closure device comprising a metallic lateral plate that laterally surrounds the outer part of the foot and with which a cuff is rotatably associated.

Although this plate stiffens the boot to a given extent, it nonetheless does not provide optimum transmission of the efforts from the foot to the ski. In current skiing technique, the ski is in fact controlled by the inner part of the leg and of the foot, and this is therefore the part of the ski boot that is most intensely stressed during skiing and that transmits the efforts.

The placement of the plate on the outer side in the prior patent is therefore not effective for precise ski control.

Italian patent no. 1,051,302 discloses a ski boot made of plastics which is substantially constituted by two shells that mutually overlap along lateral joining lines and are kept in this closed position by fastening means.

This solution, which has the purpose of providing a method for manufacturing the boot in a mold without back drafts, entails the presence of parts that allow to adapt it to devices for binding to the ski, as well as a framework formed by thick and rigid ridges and by thin flat portions that connect said ridges.

Although it partially solves the described technical problem, as the ridges affect both the outer side and the inner side of the boot, even this solution does not allow to achieve optimum transmission of efforts from the foot to the ski, because in controlling the ski, the efforts are discharged approximately at the region of the plantar arch. In the solution illustrated in the patent, this region is not affected by the rigid ridges but by the thin flat portions.

Furthermore, the arrangement and shape of the ridges in any case causes the boot to be subject to slight deformations during sports practice that help to reduce the optimum transmission of efforts to the ski.

Italian Patent application no. 82513 A/87, filed on Feb. 25, 1987 in the name of this same Applicant discloses a ski boot which is constituted by a semirigid innerboot with which it is possible to associate at least one first rigid element, which partially surrounds the lower and lateral regions of the semirigid innerboot. Two second rigid elements are arranged at the sides of the semirigid innerboot and are rotatably associated with the first rigid element and articulated to it.

This solution, too, despite partially overcoming the drawbacks described above, is not optimum as regards effort transmission, because the presence of articulations does not allow, in any case, highly efficient transmission of efforts for optimum ski control. In fact, plays generate at the articulation between the first element and the second rigid elements, also due to wear and deformations, and tend to reduce the efficiency of the transmission.

International Patent WO 92/16120 claiming an Austrian priority, no. A 631/91 dated Mar. 21, 1991, discloses a ski boot which comprises a support that can be fixed to the leg above the ankle, is connected to the sole by means of a bar, and is shaped like a stencil that can be fixed and acts together with at least one part of the shell. The stencil-like support is connected to the bar, preferably at a level located between two closed portions of said stencil-like support, by means of a bracket that approximately comprises half of the circumference of the leg.

Even this solution is not optimum as regards the transmission of efforts directly to the ski, because it is again constituted by a plurality of elements that can be coupled to each other, to the shell and to the quarter of the boot.

It is also noted that the bar is laterally provided with two arms, the lower parts thereof are associated at the heel region of the shell.

This solution is not optimum for the transmission of efforts to the ski, because this arrangement produces moments that can open out the curve or cause a self rotation in extreme circumstances.

As regards the described technical problem, this same Applicant filed an Italian application, no. 82601 A/90, on Jul. 23, 1990, claiming a quarter associated with the shell, and at least one slot being formed on said quarter at the lateral regions. The slot has the same angle, or a different angle, with respect to at least one guide formed on the shell, and at least one slider is slidingly associated between the slot and the guide.

Even this solution has drawbacks due to the fact that the quarter is laterally pivoted to the shell by means of studs or by means of a crosspiece arrangeable at a seat formed transversely and below the sole.

On one hand, in fact, the quarter does not have particular lateral support characteristics considering the material of which it is usually made, and on the other hand its tilting does not allow optimum transmission of the efforts to the ski, as the function related to the variation of the inclination that can be achieved for the quarter is privileged.

SUMMARY OF THE INVENTION

The aim of the present invention is to solve the described technical problems, eliminating the drawbacks of the above mentioned prior art and thus providing an invention that allows to achieve, for the boot, optimum transmission of the efforts from the leg to the ski and thus precise control of said ski, substantially in the absence of moments that can open out the curve or cause a self rotation.

Within the scope of the above aim, another important object is to provide an invention that ensures highly efficient transmission of efforts for optimum and immediate ski control.

Another important object is to provide an invention that associates with the preceding characteristics that of improving effort distribution, balancing the efforts between the leg and the foot.

Another object is to provide an invention that allows a distribution of the efforts that facilitates the vertical release of the toe and of the binding in safe conditions.

Another object is to provide an invention that has low manufacturing costs and also increases the aesthetic features of the boot.

This aim, these objects and others which will become apparent hereinafter are achieved by a ski boot with improved lateral support, comprising at least one quarter associated with a shell, characterized in that it comprises at least one rigid element which is monolithic, or formed integrally, with said shell and at least partially affects the inner side of the foot and leg and the plantar arch.

BRIEF DESCRIPTION OF THE DRAWINGS

Further characteristics and advantages of the invention will become apparent from the detailed description of some detailed but not exclusive embodiments, illustrated only by way of non-limitative example in the accompanying drawings, wherein.

DESCRIPTION OF THE PREFERRED EMBODIMENTS

Figure 2:
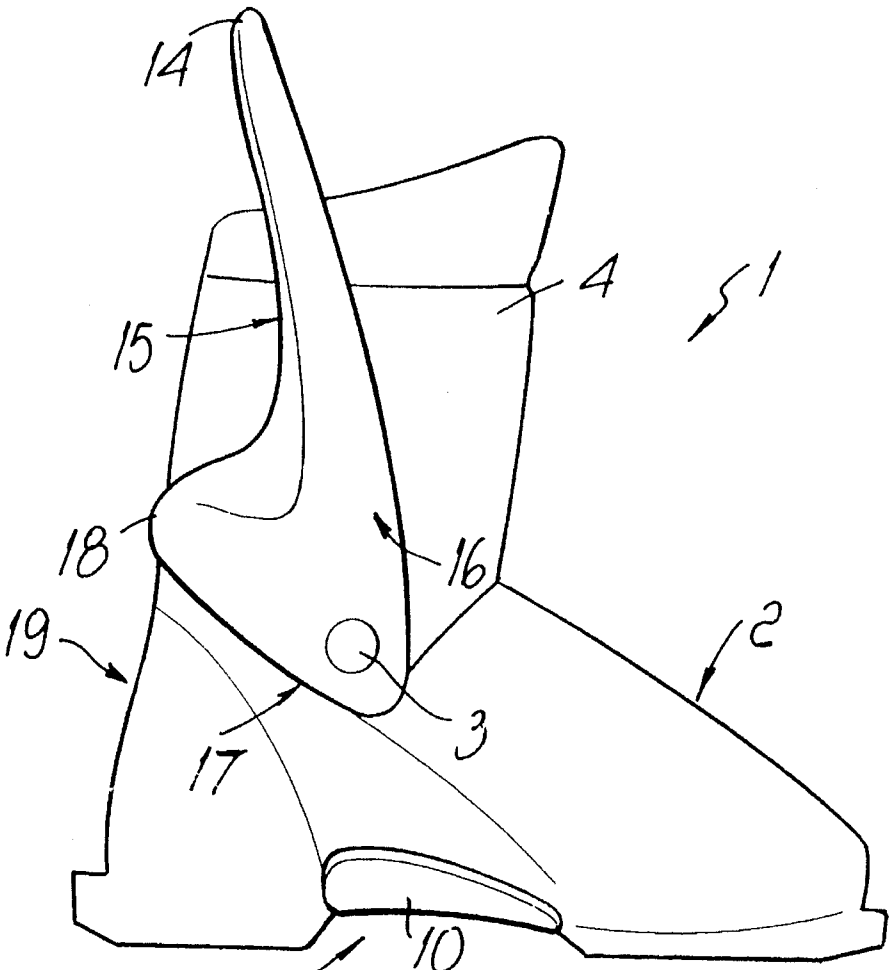
FIG. 2 is a second side view of the ski boot of FIG. 1.

With reference to the above figures, the reference numeral 1 designates the ski boot, which is constituted by at least one quarter 4 associated to a shell 2, by means of adapted studs 3.

The boot is also constituted by at least one rigid element, designated by the reference numeral 5, that is formed monolithically. The rigid element 5 has no moving components and is preferably located at the inner side 6 of the foot.

The rigid element 5 also has a first flap 7 which is adjacent both to the shell 2 and to the quarter 4 at the inner side of the foot and at the inner side 8 of the leg. The first flap is fixed to the shell and to the quarter at the studs.

Figure 1:
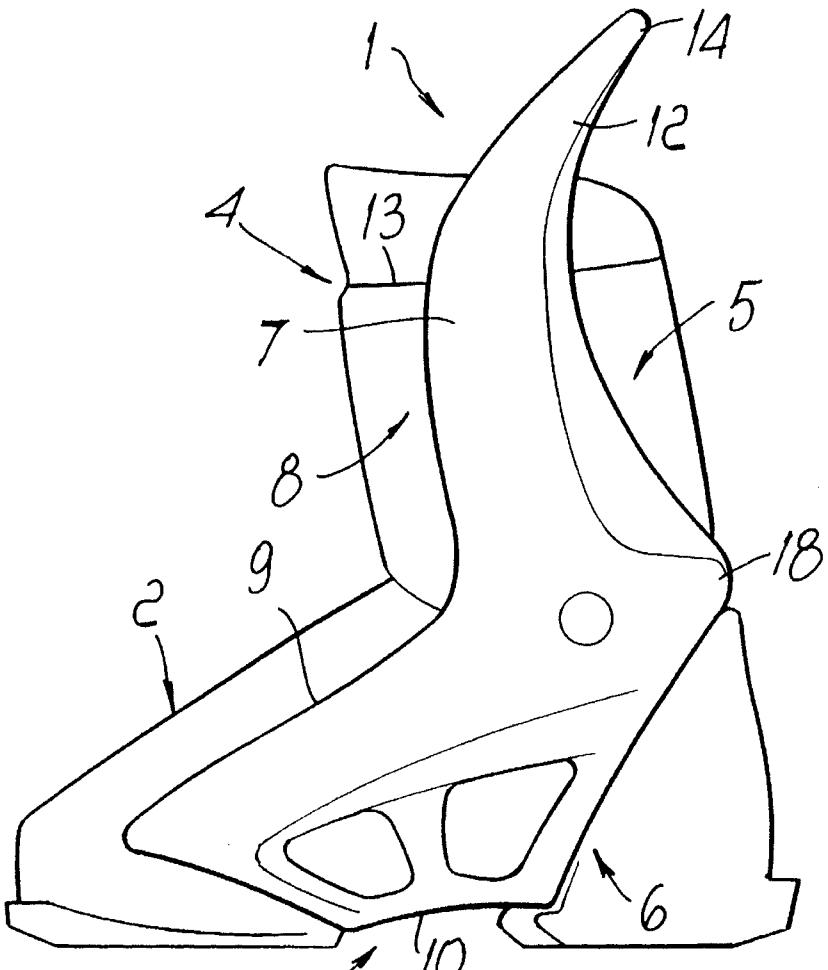
FIG. 1 is a side view of the ski boot with the rigid element applied thereto.

The first flap 7 is essentially L-shaped, and its first wing 9 runs approximately from the region in front of the heel to the metatarsal region. A C-shaped arm 10 is associated below said wing and is fixed at the plantar arch 11. As clearly visible in FIG. 1, the arm 10 extends beneath and along the plantar arch from a zone located below the malleolar region 17 of the shell 2, to a zone located below the metatarsal region thereof.

The second wing 12 in the first flap 7 advantageously protrudes beyond the upper perimetric edge 13 of the quarter 4, and surrounds it to the rear. The second wing 12 is connected to a second flap 15 by means of a first bridge 14. The second flap 15 affects the outer side 16 of the leg and is then fixed at the studs 3 at the end that lies approximately adjacent to the malleolar region 17.

The first and second flaps are also mutually connected by means of a second bridge 18 at the region overlying the heel 19.

The rigid monolithic element is advantageously arranged both on the inner side of the foot and on the outer side of the leg and, in view of the fact that it is rigidly fixed at the plantar arch, allows to achieve optimum ski control. The ski control in fact substantially occurs by means of the inner side of the foot and of the leg, and the transmission of efforts from these parts to the ski is discharged approximately at the plantar arch, which can thus be defined as the "control center" of the foot.

The structure and arrangement of the rigid element therefore allows to transmit forces in a precise and immediate manner, substantially without moments that can open out the curve or cause self rotation. The absence of articulations ensures the highly efficient transmission of efforts for optimum ski control.

Furthermore, the shape of the rigid element 5, which flares out from the bottom upward starting from the region of the plantar arch 11, improves effort distribution, balancing these efforts between the leg (substantially in the application of efforts in the rear region, as well as lateral efforts for control and edge grip) and the foot (substantially in the application of efforts in the front region to achieve tight curves and quick reversals).

It has thus been observed that the invention has achieved the intended aim and objects, furthermore obtaining an optimum rear support that also discharges backward efforts onto the load-bearing structure of the boot.

The shape of the rigid element 5 and the related effort distribution furthermore facilitate the vertical release of the toe unit of the binding in safe conditions, because the resting effort that acts on said rigid element is not discharged fully onto the heel, as usually occurs in the prior art, but a part of said effort produces an overturning moment beneath the sole, thus facilitating vertical release.

The ski boot according to the invention is naturally susceptible to numerous modifications and variations, all of which are within the scope of the same inventive concept.

Figure 4:
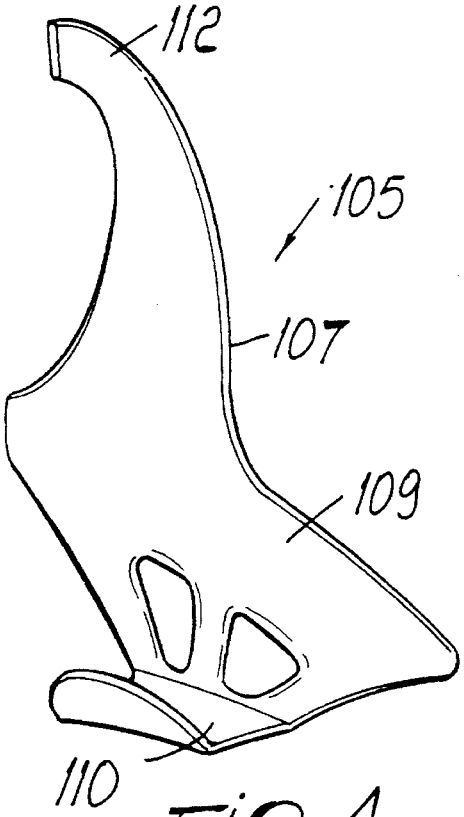
FIG. 4 is a view, similar to the preceding one, of the rigid element according to a further aspect of the invention.
Figure 8:
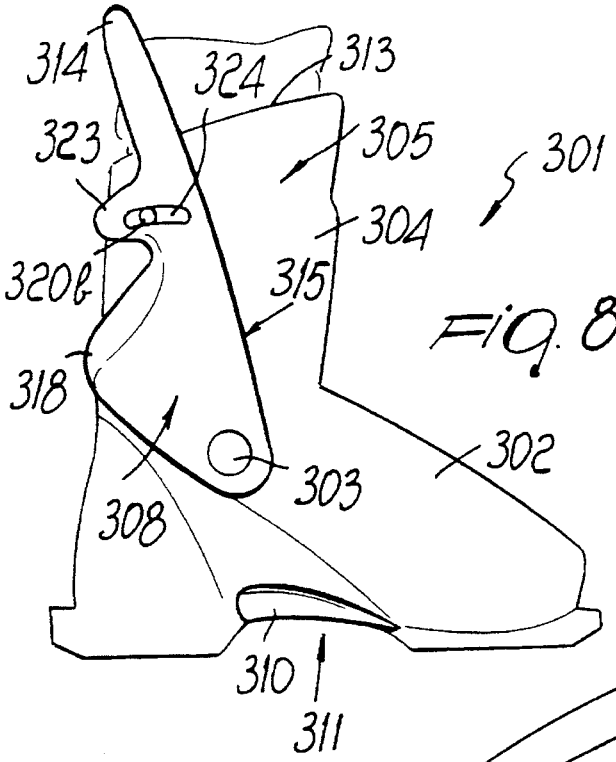
FIG. 8 is a view, similar to FIG. 2, of the ski boot shown in the preceding figure.
Figure 9:
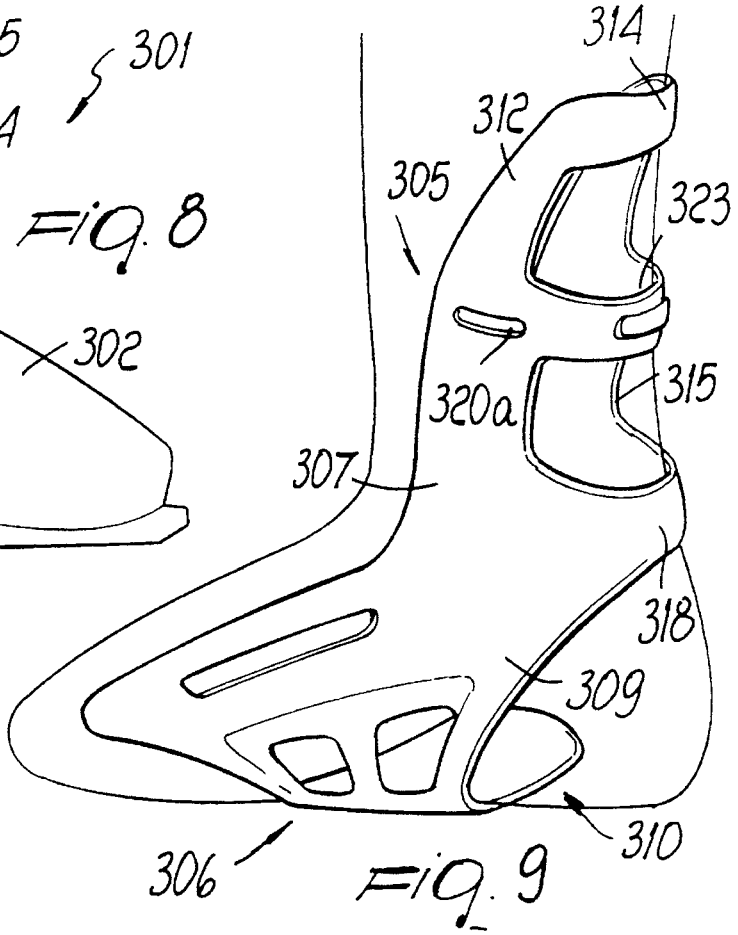
FIG. 9 is a rear perspective view of the rigid element according to still a further aspect of the invention.
Figure 10:
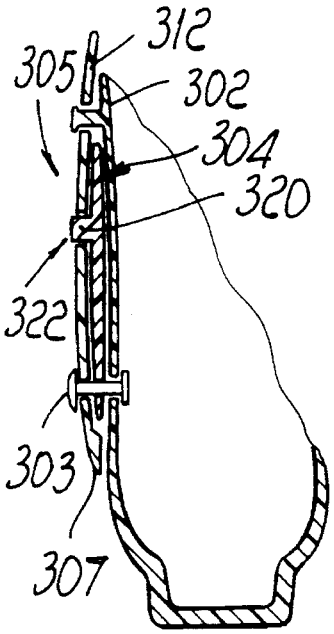
FIG. 10 is another sectional view, taken along the plane X—X of FIG. 7.
Figure 7:
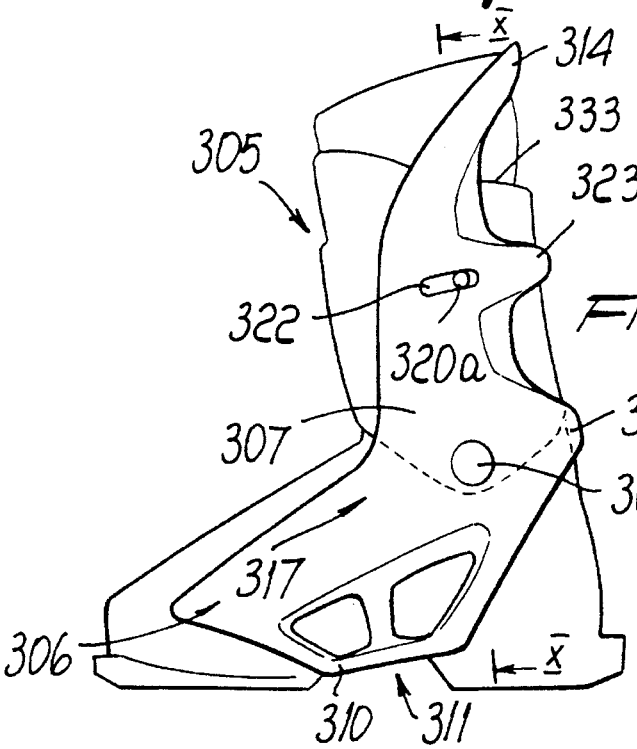
FIG. 7 is a view, similar to FIG. 1, of another embodiment of the invention.

Thus, for example, FIG. 4 illustrates a rigid element 105 which is constituted only by a first flap 107 the first wing 109 thereof is associated with the arm 110 in a downward region. The arm is fixed at the plantar arch region.

The first wing 109 and the second wing 112 of the first flap 107 thus affect the inner side of the foot and the inner side of the leg.

Figure 5:
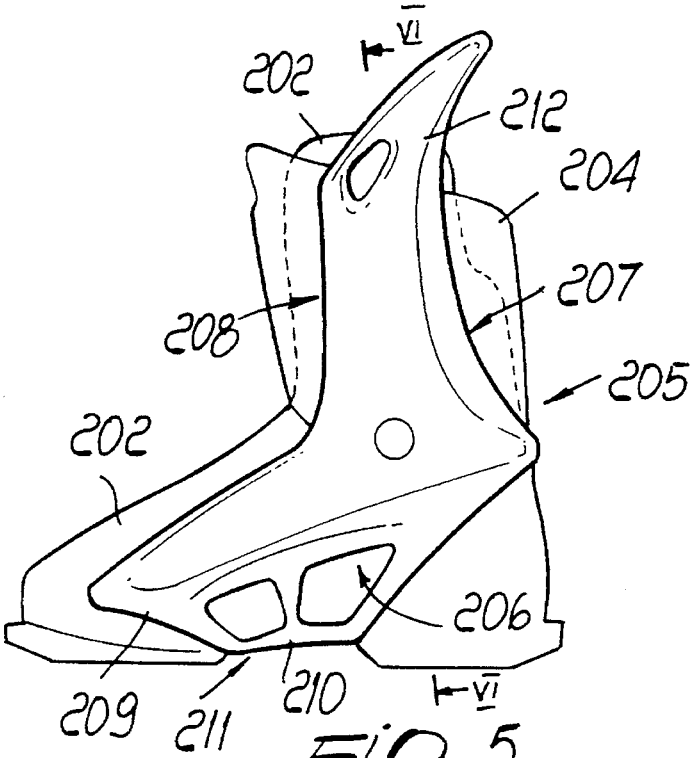
FIG. 5 is a view, similar to FIG. 1, of a further embodiment of the invention.
Figure 6:
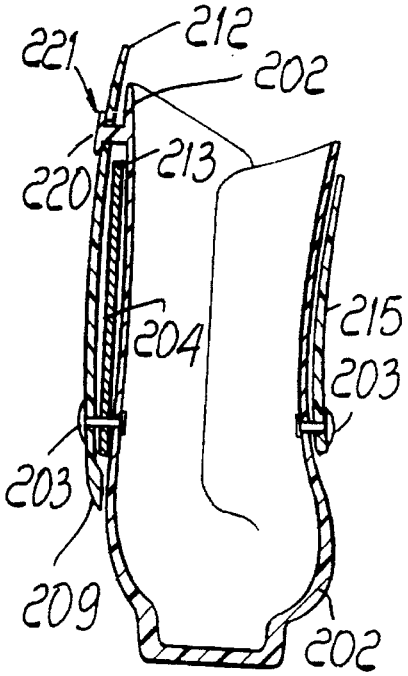
FIG. 6 is a sectional view, taken along the plane VI—VI of FIG. 5.
Figure 3:
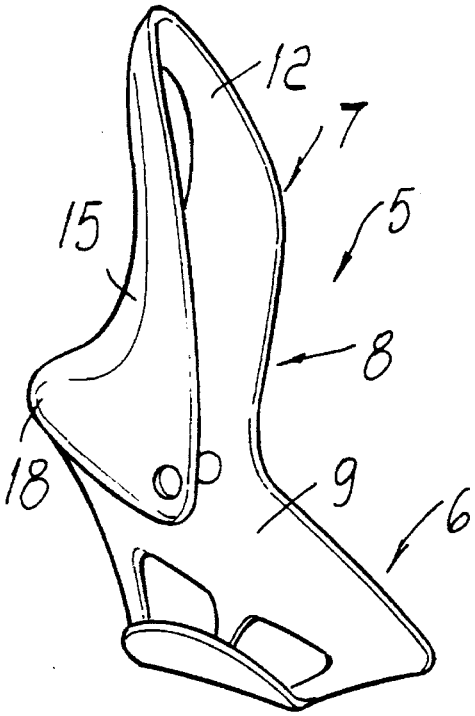
FIG. 3 is a perspective view of the rigid element alone.

FIGS. 5 and 6 illustrate another embodiment of a boot 201 constituted by at least one quarter 204 associated with a shell 202.

Here also there is a rigid element 205 constituted by a first flap 207 which has a first wing 209 and a second wing 212 that respectively affect the inner side 206 of the foot and the inner side 208 of the leg.

Here also below the first wing 209 there is an arm 210 which is rigidly associated at the plantar arch 211.

The first flap 207 is also fixed to the shell 202 and to the quarter 204 by means of the studs 203. The second wing 212 is directly connected to the shell 202, and a lug 220 protrudes from the shell and can be arranged at a complementarily shaped opening 221 that is formed on the second wing 212, above the upper perimetric edge 213 of the quarter 204.

The second flap 215 is instead fixed to the shell 202 by means of the studs 203.

FIGS. 7 to 10 illustrate another embodiment of a ski boot 301 which is composed of at least one quarter 304 associated with a shell 302.

Here also there is a monolithic rigid element 305 which is constituted by a first essentially L-shaped flap 307 the first wing 309 thereof affecting the inner side 306 of the foot. An arm 310 is associated in a downward region with said wing and is fixed at the plantar arch 311.

A first arched, or curved, slot 322 is formed at the second wing 312, and its rotation center is arranged approximately at the axis of the studs 303.

The first slot 322 constitutes a guiding element for the rotation of the quarter 304, which has at least one adapted lug 320*a* which is rigidly coupled to, and protrudes externally from, the quarter 304 and slidingly engages the first slot 322; the lug 320*a* is thus suitable to limit the rotation of the quarter 304.

The tip of the second wing 312 that protrudes above the upper perimetric edge 313 of the quarter 304 is connected to a second flap 315, by means of a first bridge 314. The second flap 315 affects the inner side 308 of the leg and is fixed at the studs 303, at its loose end.

The connection between the second wing 312 of the first flap 307 and the second flap 315 occurs also by means of a second bridge 318 that lies above the malleolar region 317 and by means of a third bridge 323 which is arranged in a median region with respect to the first and second bridges.

A second arched slot 324 is formed at the second flap 315 as well. The slot center of rotation lies approximately at the axis of the stud 303, and the slot, too, acts as guiding element for the rotation of the quarter 304. This oscillation is limited by the presence of a lug 320*b* that protrudes outside the quarter 304 and engages the slot 324.

In the interspace between the ends of the first and second slots and the respective lugs it is possible to interpose an element, for example a plastic block, that has the required degree of elasticity and thus allows to change the forward or backward flexing of the quarter.

The inclination of the quarter can also be changed by interposing a spacer element, at the first bridge 314 and/or at the second bridge 318 and/or at the third bridge 323 and at the outer lateral surface of the quarter 304. The spacer element may have the desired thickness.

Naturally, the materials and the components that constitute the boot may be the most pertinent according the specific requirements.

What is claimed is:

1. In combination, a ski boot having a shell defining a heel region, a malleolar region, a metatarsal region, a plantar arch, a foot inner side and a foot outer side, and a quarter connected to said shell and defining a leg inner side and a leg outer side, and a rigid lateral support element comprising;

a first flap connected to said ski boot and located adjacent said foot inner side of said shell and said leg inner side of said quarter;

a first wing defined by said first flap and extending from said heel region to said metatarsal region at said foot inner side of said shell, and;

an arm extending from said first wing beneath said plantar arch, and stud means connecting said quarter to said shell and fixing said first flap of said rigid lateral support element to said leg inner side of said quarter and to said foot inner side of said shell.

2. The combination according to claim 1, further comprising a second flap connected to said first flap and located adjacent said outer leg side of said quarter, said second flap having an end, said end of said second flap being connected to said malleolar region of said shell by said stud means.

3. The combination according to claim 2, further comprising a first bridge, first wing defined by said first flap and extending from said heel region to said metatarsal region at said foot inner side of said shell, and a second wing defined by said first flap of said rigid lateral support element, said first bridge interconnecting said second wing of said first flap and said second flap.

4. The combination according to claim 3, further comprising a second bridge, said second bridge being located below said first bridge and interconnecting said second wing and said second flap at a location overlying said heel region of said shell.

5. The combination according to claim 4, wherein said first wing and said second wing of said first flap, said arm, said second flap, said first bridge and said second bridge are formed monolithically.

6. The combination according to claim 1, further comprising;

a second wing defined by said first flap at said leg inner side of said quarter;

an upper perimetric edge defined by said quarter;

an opening formed on said second wing above said upper perimetric edge, and;

a lug protruding from said shell into said opening formed on said wing.

7. The combination according to claim 1, further comprising;

a second wing defined by said first flap;

a curved slot formed on said second wing, and;

a lug protruding externally from said quarter and slidingly engaging said curved slot in said second wing;

wherein said quarter is rotatable with respect to said shell about said stud means, and wherein rotation of said quarter with respect to said shell is limited by movement of said lug in said curved slot.

8. In combination, a ski boot having a shell defining a heel region, a malleolar region, a metatarsal region, a plantar arch, a foot inner side and a foot outer side, a quarter defining a leg inner side and a leg outer side, and stud means connecting said quarter to said shell, and a rigid lateral support element comprising;

a first flap connected to said ski boot and located adjacent said foot inner side of said shell and said leg inner side of said quarter;

a first wing defined by said first flap and extending from said heel region to said metatarsal region at said foot inner side of said shell, and;

an arm extending from said first wing beneath said plantar arch and extending along said plantar arch from a zone located below said malleolar region of said shell to a zone located below said metatarsal region thereof, wherein said first flap of said rigid lateral support element is fixed to said leg inner side of said quarter and to said foot inner side of said shell by said stud means.

9. The combination according to claim 8, further comprising a second flap connected to said first flap and located adjacent said outer leg side of said quarter, said second flap having an end, said end of said second flap being connected to said malleolar region of said shell by said stud means.

10. The combination according to claim 9, further comprising a first bridge, and a second wing defined by said first flap of said rigid lateral support element, said first bridge interconnecting said second wing of said first flap and said second flap.

11. The combination according to claim 10, further comprising a second bridge, said second bridge being located below said first bridge and interconnecting said second wing and said second flap at a location overlying said heel region of said shell.

12. The combination according to claim 11, wherein said first wing and said second wing of said first flap, said arm, said second flap, said first bridge and said second bridge are formed monolithically.

13. In combination, a ski boot having a shell defining a heel region, a malleolar region, a metatarsal region, a plantar arch, a foot inner side and a foot outer side, a quarter defining a leg inner side and a leg outer side, and stud means connecting said quarter to said shell, and a rigid lateral support element comprising;

a first flap connected to said ski boot and located adjacent said foot inner side of said shell and said leg inner side of said quarter;

a first wing formed monolithically with said first flap and extending from said heel region to said metatarsal region at said foot inner side of said shell, and;

an arm formed monolithically with and extending from said first wing beneath said plantar arch and extending along said plantar arch from a zone located below said malleolar region of said shell to a zone located below said metatarsal region thereof, wherein said first flap of said rigid lateral support element is fixed to said leg inner side of said quarter and to said foot inner side of said shell by said stud means.

14. The combination according to claim 13, further comprising a second flap formed monolithically with said first flap and located adjacent said outer leg side of said quarter, said second flap having an end, said end of said second flap being connected to said malleolar region of said shell by said stud means.

15. The combination according to claim 14, further comprising a first bridge, a second bridge, and a second wing defined by said first flap of said rigid lateral support element, said first bridge interconnecting and formed monolithically with said second wing of said first flap and said second flap, said second bridge being located below said first bridge and being formed monolithically with and interconnecting said second wing and said second flap at a location overlying said heel region of said shell.

* * * * *